US006414636B1

(12) United States Patent
Godard et al.

(10) Patent No.: US 6,414,636 B1
(45) Date of Patent: Jul. 2, 2002

(54) RADIO FREQUENCY CONNECTOR FOR REDUCING PASSIVE INTER-MODULATION EFFECTS

(75) Inventors: Jeffrey A. Godard, Littleton, CO (US); Michael W. McRae, Citrus Heights, CA (US); Steven C. Olson, Broomfield, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 09/383,342

(22) Filed: Aug. 26, 1999

(51) Int. Cl.[7] ..... H01Q 13/08; H01P 5/00

(52) U.S. Cl. ..... 343/700 MS; 333/24; 333/260; 333/12

(58) Field of Search ..... 333/24 C, 260, 333/246, 12, 1; 343/700 MS, 795

(56) References Cited

U.S. PATENT DOCUMENTS 5,392,053 A * 2/1995 Hirata et al. ..... 343/700 MS 5,757,246 A * 5/1998 Johnson ..... 333/24 C X

FOREIGN PATENT DOCUMENTS

JP 247606 * 10/1987 ..... 333/260

* cited by examiner

*Primary Examiner*—Benny T. Lee
(74) *Attorney, Agent, or Firm*—Sheridan Ross P.C.

(57) ABSTRACT

A radio frequency connector for coupling radio frequency energy into or out of an antenna apparatus includes a ground portion that is both capacitively and conductively coupled to a ground structure within the antenna apparatus. The connector is designed so that radio frequency (RF) signals within the operative frequency range of the antenna apparatus flow predominantly through the capacitive ground connection of the connector, rather than through the conductive ground connection of the connector. Direct current signals and other low frequency signals within the antenna apparatus, on the other hand, have a direct path to ground through the conductive ground connection. Because the RF signals flow predominantly through the capacitive ground connection, the likelihood that passive inter-modulation (PIM) products will be generated within the metal-to-metal junctions of the conductive ground connection is significantly reduced.

25 Claims, 4 Drawing Sheets

RADIO FREQUENCY CONNECTOR FOR REDUCING PASSIVE INTER-MODULATION EFFECTS

FIELD OF THE INVENTION

The invention relates generally to antenna systems and, more particularly, to methods for coupling energy into and out of an antenna apparatus or the like from an external transmission line structure.

BACKGROUND OF THE INVENTION

Metal-to-metal junctions in electronic circuitry are known to sometimes cause the "diode junction effect" which has results in a non-linear voltage-current characteristic. Radio frequency (RF) signals flowing through such a non-linear junction have been known to create inter-modulation products having frequencies that are different from the original RF signals. This frequency effect is known as passive inter-modulation (or PIM). Sometimes these passive inter-modulation products will manifest themselves as relatively strong interference signals within the underlying system that can compromise system performance. At a minimum, these products can make it more difficult to meet system specifications for spurious signal levels. Thus, junctions that are likely to generate such non-linear effects should generally be avoided.

Therefore, there is a need for circuit structures in radio frequency systems that avoid the use of metal-to-metal junctions in the RF signal flow path.

SUMMARY OF THE INVENTION

The present invention relates to a connector structure for use in transferring radio frequency (RF) energy into and/or out of an RF circuit module. The connector structure utilizes capacitive coupling to provide an RF ground connection for the module, thus avoiding metal-to-metal contact in the RF signal ground path. The connector structure also provides a direct current (DC) ground connection for use in providing a signal flow path for DC and other low frequency signal components. The connector structure is designed so that a majority of the RF signal energy flowing through the connected ground connection flows through the capacitive coupling and relatively little flows through the DC short. Thus, the probability of generating passive inter-modulation products within the metal-to-metal contacts of the DC short are significantly reduced. The connector structure is particularly beneficial in applications involving relatively high RF signal current levels, such as in transmit antennas being fed by high output power amplification circuits.

DETAILED DESCRIPTION OF A PREFERRED EMBODIMENT

The present invention relates to a connector structure for use in transferring radio frequency (RF) energy into and/or out of an RF circuit module. The connector structure utilizes capacitive coupling to provide an RF ground connection for the module, thus avoiding metal-to-metal contact in the RF signal ground path. The connector also provides a direct current (DC) ground connection for use in providing a signal flow path for DC and other low frequency signal components. The connector is designed so that a majority of the RF signal energy flowing through the connector ground connection flows through the capacitive coupling and relatively little flows through the DC short. Thus, the probability of generating passive inter-modulation products within the metal-to-metal contacts of the DC short are significantly reduced. The connector structure of the present invention is particularly beneficial in applications involving relatively high RF signal current levels, such as in transmit antennas being fed by high output power amplification circuits.

Figure 1:
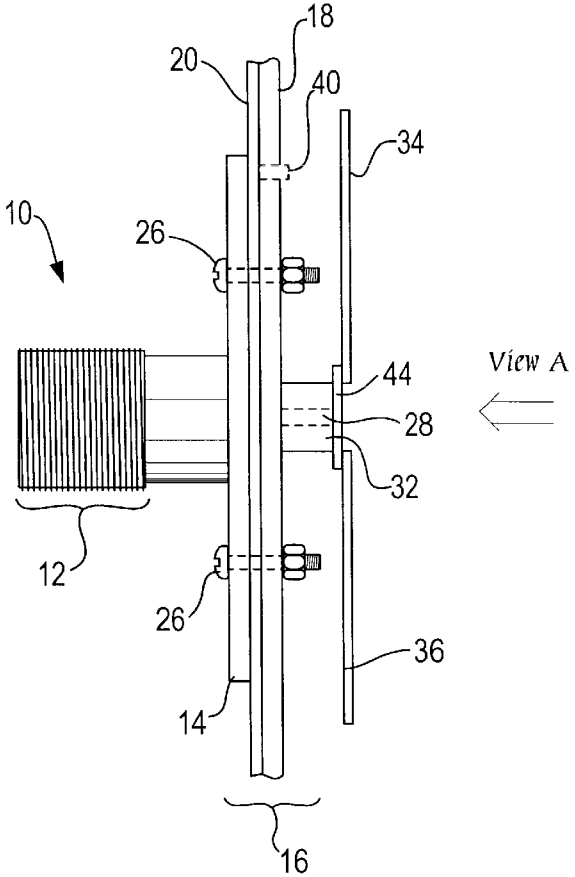
FIG. 1 is a side view illustrating a connector for use in coupling RF energy in/out of a circuit housing in accordance with one embodiment of the present invention.
Figure 1:
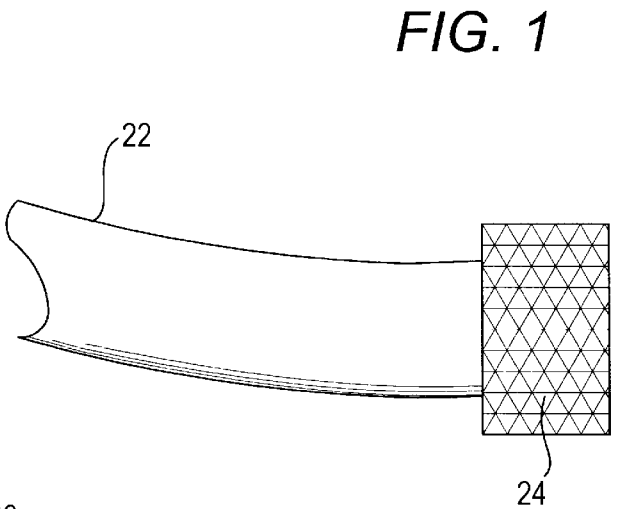

FIG. 1 is a sectional side view illustrating a connector 10 in accordance with one embodiment of the present invention. The connector 10 is operative for coupling RF energy between circuitry (not shown) within a circuit housing 16 and a coaxial cable 22 located outside the circuit housing 16. In a preferred embodiment, the circuitry within the circuit housing 16 includes one or more antenna elements for providing wireless communication with a remote entity. It should be appreciated that the term "housing", as used herein, can apply to a base structure or chassis upon which circuitry is built and is not limited to structures which enshroud or envelope internal circuitry. As illustrated, the connector 10 includes a conductive coaxial transition 12 where the coaxial cable 22 can be attached to the connector 10. In the illustrated embodiment, the conductive coaxial transition 12 includes a threaded portion onto which a connector 24 on the coaxial cable 22 can be attached.

As is well known to persons of ordinary skill in the art, a coaxial cable is a transmission line structure having a center conductor which may be surrounded by a dielectric material which, in turn, is surrounded by one or more outer conductors or shields in a concentric arrangement. The shield may or may not be surrounded by a protective dielectric jacket. In addition to facilitating the flow of radio frequency energy through the cable, the shield generally operates as a ground for the cable. That is, the shield is normally connected to a system ground (typically earth ground) at at least one end of the cable. The portion of the cable connector 24 that is attached to the conductive coaxial transition 12 of the connector 10 is conductively coupled to the shield of the coaxial cable 22. Therefore, the coaxial transition 12 is grounded to the system ground through the coaxial cable 22 when the cable 22 is attached thereto.

Figure 2:
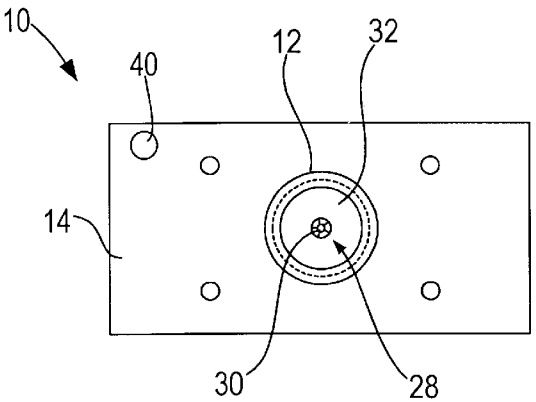
FIG. 2 is a front view of the connector of FIG. 1.

As shown in FIGS. 1 and 2, the connector 10 includes a relatively large flange 14 which is preferably integral with the coaxial transition 12. Both the coaxial transition 12 and the flange 14 are made of a conductive material, preferably a metal having good conductive properties. In a preferred embodiment, for example, white bronze plated brass is used, although a number of different metals or alloys can be used in the alternative. Because the coaxial transition 12 and the flange 14 are conductively coupled to one another, the flange 14 will also be grounded to the system ground through the coaxial cable 22 when the cable 22 is attached to the connector 10.

Figure 3:
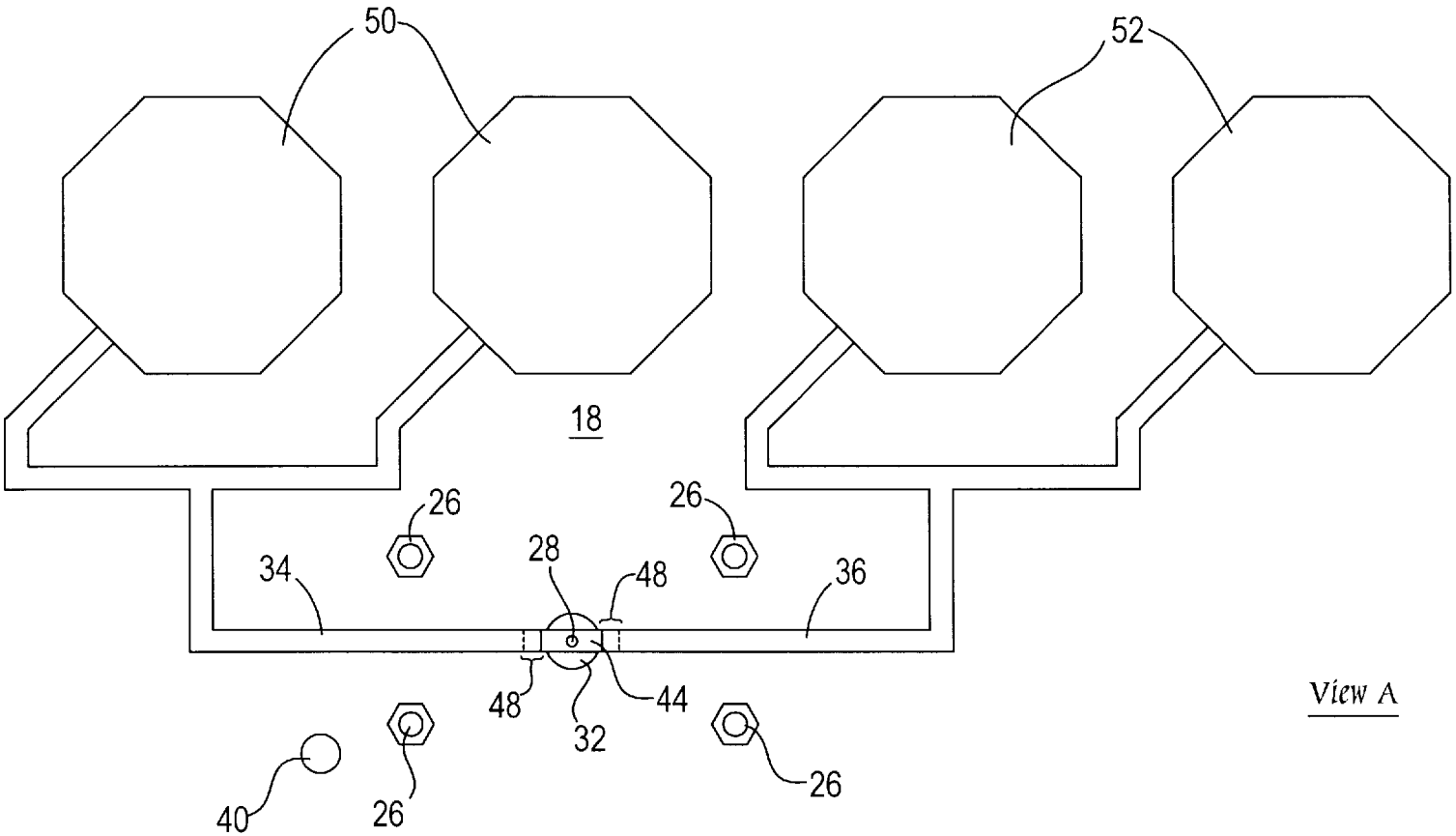
FIG. 3 is a top view of antenna circuitry within the housing of FIG. 1 that is coupled to the connector in one embodiment of the present invention.

The flange 14 of the connector 10 is attached to a circuit housing 16 using one or more fasteners 26, as referenced in FIGS. 1 and 3. In the illustrated embodiment, the fasteners 26 include a plurality of screws that extend through corresponding holes in the flange 14 and the housing 16 and that are secured with nuts on the inside of the housing 16. Because a conductive connection through the screws is undesired, non-conductive screws or conductive screws with, for example, non-conductive bushings and washers are used to attach the connector 10 to the housing 16. As can be appreciated, any of a number of alternative non-conductive fastening methods can be used to secure the connector 10 to the housing 16, including the use of clamps, adhesives, and/or snap-in fasteners.

In the illustrated embodiment, the housing 16 includes a conductive ground plane structure 18 that is separated from the flange 14 by a dielectric layer 20. Thus, a capacitance is formed between the flange 14 and the ground plane 18. The value of the capacitance is designed so that the connection appears to be a short circuit (i.e., very low impedance) within the frequency range of interest (e.g., the operational frequency range of the internal circuitry). The ground plane 18 is part of an overall ground structure within the housing 16 that is used by all circuitry within the housing 16 that requires a ground. Thus, the flange 14 and the coaxial transition 12 of the connector 10 are tightly capacitively coupled to the circuit ground within the circuit housing 16 within the frequency range of interest.

As illustrated in FIG. 1, the ground plane 18 may also perform a structural function by mechanically supporting the connector 10. That is, the ground plane 18 can be part of a wall or floor of a metallic circuit housing or chassis that carries the circuitry.

The dielectric layer 20 can be interposed between the flange 14 and the ground plane 18 in any of a number of different ways. For example, in one approach, a dielectric sheet (e.g., a dielectric tape) is adhered to an outer surface of the ground plane 18 before the connector flange 14 is attached thereto. In another approach, a dielectric layer is grown, deposited, or painted onto the outer surface of the ground plane 18 before the flange 14 is attached. Alternatively, dielectric material can be adhered, grown, deposited, or painted on the flange 14 itself In yet another approach, a dielectric gasket is used between the flange 14 and the ground plane 18. Because a predetermined minimum capacitance value is required between the flange 14 and the ground plane 18, the thickness and dielectric constant of the dielectric layer 20 must be relatively controlled. In addition, the face area of the flange 14 must be relatively precise.

The connector 10 also includes a center conductor for use in coupling RF energy from the center conductor of the coaxial cable 22 to the circuitry within the circuit housing 16. FIG. 2 is a front view of the connector 10 illustrating a center conductor 28 within the connector 10. The center conductor 28 is centered and held stationary within the connector 10 by a dielectric insert 32 within the connector 10. When the cable connector 24 (see FIG. 1) is attached to the coaxial transition 12 of the connector 10, a center conductor pin (not shown) within the cable connector 24 is inserted into the center of a ring 30 of flexible conductive members on the center conductor 28 that grip the pin to provide a conductive junction.

As shown in FIGS. 1 and 3, the center conductor 28 and the dielectric insert 32 of the connector 10 extend outward past the flange 14 of the connector 10 and into the circuit housing 16. In the illustrated embodiment, the center conductor 28 is conductively coupled to connectors 34, 36 of transmission line structures within the housing 16. FIG. 3 is a top view (corresponding to view A in FIG. 1) of the circuitry on the inside of the housing 16 in FIG. 1 showing the connection of the transmission line structures having conductors 34 and 36 in one embodiment of the present invention. As illustrated, each of the conductors 34, 36 feeds a corresponding pair of air-loaded patch antenna elements 50, 52 that are each suspended above the ground plane 18, as also illustrated in FIG. 3, using dielectric spacers (not shown). The center conductor 28 of the connector 10 includes a cross bar member 44 (see FIG. 1) which is conductively coupled (e.g., soldered) to an end portion 48 of each of the transmission line conductors 34, 36. In an alternative embodiment (not shown), the cross bar member 44 is capacitively coupled to the transmission line center conductors 34, 36 to avoid metal-to-metal junctions in the conductor signal flow path. That is, a dielectric layer is interposed between each of the conductors 34, 36 and the cross bar member 44 to provide a predetermined capacitance value between the elements. In one embodiment, the capacitively coupled conductors 34, 36 and the cross bar member 44 are held together using shrink wrap tubing or the like.

Because the ground portion of the connector 10 is capacitively coupled to the ground plane 18, there is no metal-to-metal contact within the RF ground path through the connector 10 that can potentially cause passive inter-modulation effects. In conceiving of the present invention, it was appreciated that the RF ground path into or out of a circuit housing is generally more likely to generate PIM effects than the center conductor path because the structures forming the RF ground path are usually exposed to environmental factors (e.g., rain, humidity, wind, etc.) to a greater extent than is the center conductor. These environmental factors are known to result in an increased incidence of PIM in areas of metal-to-metal contact. However, the lack of a conductive connection between the flange 14 of the connector 10 and the ground structure within the housing 16 results in a situation where there is no ground return within the housing 16 through which DC or other low frequency currents can flow to earth ground. This can lead to arching and other problems when large charges are built up in the circuitry that had no place to go, such as the charges that may form in an externally-mounted antenna circuit during a lightening storm. Therefore, in accordance with one aspect of the present invention, a short circuiting member 40 (see FIGS. 1, 2 and 3) is implemented for providing a DC current path between the connection shield (i.e., system ground) and the ground structure within the housing 16.

In accordance with the invention, the size and location of the short circuiting member 40 is designed so that very little of the RF energy flowing through the ground connection of the connector during normal operation will flow through the short circuiting member 40. That is, the short circuiting member 40 is designed so that the RF signals within the frequency range of interest see a much smaller impedance through the capacitor junction than they see through the short circuiting member 40 and thus flow predominantly through the capacitor junction. Because the RF signals flow predominantly through the capacitor, there is very little chance that PIM generation will occur in the localized metal-to-metal contact junctions within the flow path through the short circuiting member 40. Thus, the PIM problem is avoided even though a metal-to-metal junction exists between the connector shield and the ground plane 18.

In a preferred embodiment, as best shown in FIG. 1, the short circuiting member 40 consists of a rigid metallic stud that is integrally connected to the connector flange 14. When the connector 10 is installed, the short circuiting stud passes through a hole in the housing 16 after which it is conductively secured to the ground plane 18. In one approach, the short circuiting stud includes a threaded end portion and a nut is used to secure the short circuiting stud to the ground plane 18. In other approaches, the short circuiting stud is welded, soldered, or cemented to the ground plane 18 using, for example, a conductive resin. The short circuiting stud is preferably a relatively narrow member having a high inductance so that the impedance of the short circuiting stud in the operative frequency range is much greater (e.g., greater than five times) than the impedance of the capacitor. The thickness of the short circuiting stud should be enough, however, to safely and reliably carry worst case DC and low frequency current levels that might appear in the circuit. The short circuiting stud is preferably located as far from the conductive coaxial transition on the flange 14 as possible. This is because high RF current will generally radiate outwards on the flange 14 from the coaxial transition 12 during high powered feed operations and the magnitude of these RF currents will generally be less at the far edges of the flange 14 than they are near the coaxial transition 12. Therefore, location of the short circuiting stud near, for example, a far edge of the flange 14 will decrease the likelihood that high RF currents will flow through the short circuiting stud.

The short circuiting member 40 can take forms other than the rigid stud described above. In fact, virtually any form of short circuiting member 40 can be used that will provide a ground path for low frequency signals within the housing while allowing the majority of the RF signal current to flow through the capacitive junction of the connector 10. In this regard, wires, plated through holes, conductive bars, sheets or foils, and other alternative structures can be used to provide the shorting. The short circuiting member 40 can be attached through any grounded portion of the connector 10 and is not limited to connection to the flange 14. In addition, the short circuiting member 40 can be attached to any portion of the ground structure within the housing 16 and is not limited to connection to the portion of the ground plane 18 that forms the capacitive connection with the connector 10.

Figure 4:
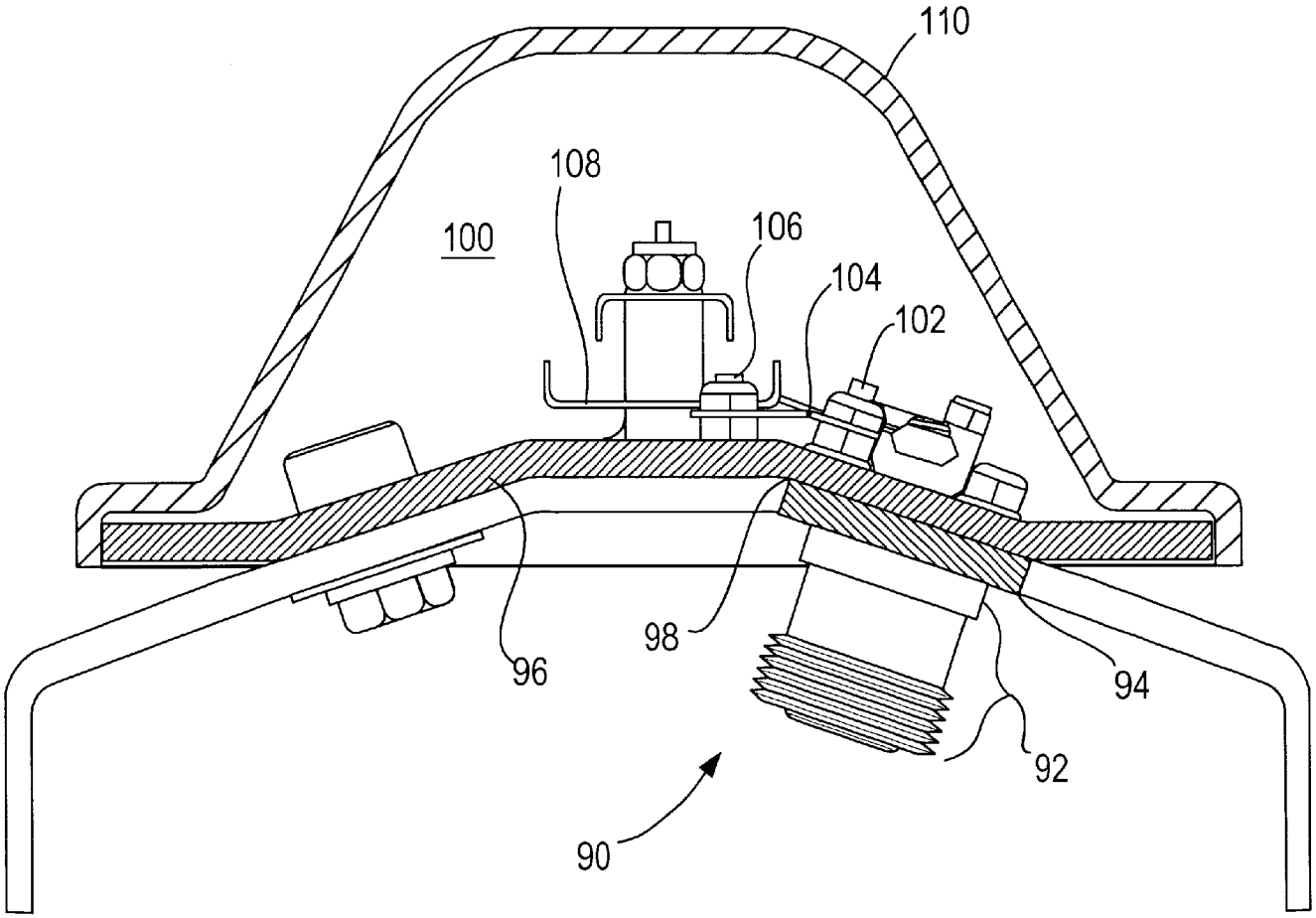
FIG. 4 is a sectional side view illustrating a more detailed connector arrangement in accordance with the present invention.

FIG. 4 is a sectional side view of a connector arrangement 90 that is similar to the arrangement illustrated in FIG. 1. The connector 90 includes a threaded coaxial transition 92 and an integral flange 94. The flange 94 is capacitively coupled through a dielectric layer 98 to a ground plane 96 that is part of an antenna housing 100. A conductive short circuiting stud 102 on the flange 94 projects through the ground plane 96 without making conductive contact therewith. A grounding strap 104 is then used to conductively couple the short circuiting stud 102 to the ground plane 96 (via terminal stud 106) inside the housing 100. The grounding strap 104 is used to achieve a requisite amount of inductance in the DC ground path to ensure that RF currents will flow through the capacitive junction rather than the DC ground path. As before, the center conductor of the connector 90 is conductively coupled to a transmission structure within the antenna housing that feeds one or more antenna elements, as seen in FIG. 4, located therein. A radome 110 is also provided for protecting the antenna circuitry from the exterior environment.

Figure 5:
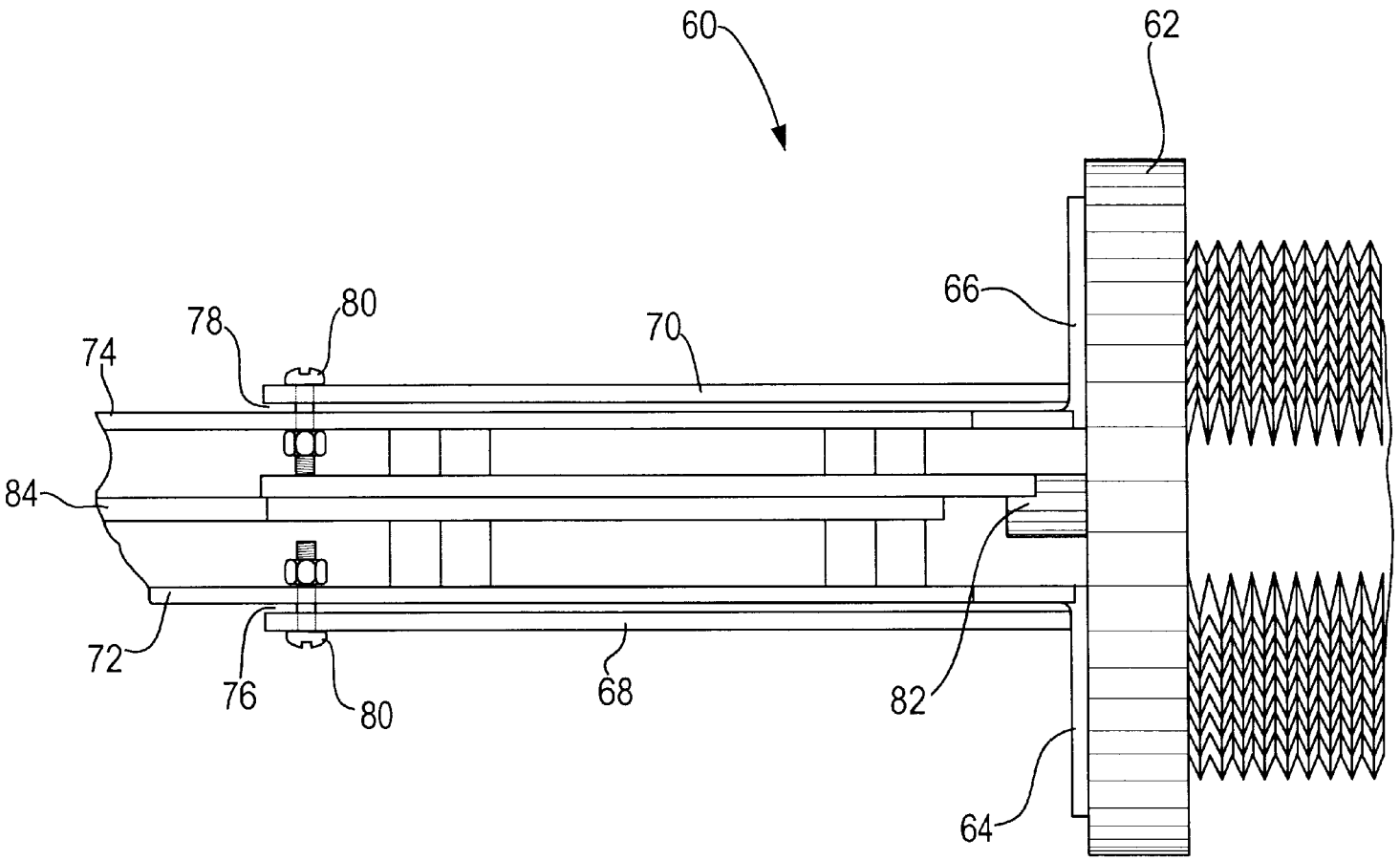
FIG. 5 is a side view illustrating a connector for use in coupling RF energy in/out of a circuit housing in accordance with another embodiment of the present invention.

FIG. 5 is a side view of a connector 60 in accordance with another embodiment of the present invention. The connector 60 also uses capacitive coupling to provide an RF ground connection, but the capacitive coupling does not utilize the flange 62 of the connector 60 as one of plates of the capacitor. Instead, a pair of flange extenders 64,66 that are conductively coupled to (and preferably integral with) the flange 62 are utilized to form the needed capacitance. The flange extenders 64, 66 each include a horizontal extension member 68, 70 that extends into a corresponding circuit housing (not shown) when the connector 60 is installed. Each of the horizontal extension members 68, 70 is separated from a corresponding ground plane 72, 74 by a respective dielectric layer 76, 78. Thus, the flange 62 is capacitively coupled to the ground planes 72, 74. As in the previous embodiment, the capacitance value of the RF ground connection is chosen to appear as a near short circuit within the operative frequency range of the corresponding circuitry. Thus, the thickness and dielectric constant of the dielectric layers 76, 78 and the area of overlap of the horizontal extension members 68, 70 with the corresponding ground planes 72, 74 is designed to achieve the desired capacitance value.

In addition, as in the previous embodiment, a short circuiting member 80 is used to provide a DC ground path through the connector 60. In the illustrated embodiment, a screw and nut is used to short each horizontal extension member 68, 70 to a corresponding ground plane 72, 74. As can be appreciated, any of a number of alternative shorting techniques, such as those discussed previously, can also be used. Similar to the previous embodiment, the short circuiting member 80 is preferably placed as close to the far edge of each horizontal extension member 68, 70 as possible to avoid regions of maximal RF current. Also, the impedance of the shorted connection within the operative frequency band should be significantly higher than the impedance of the capacitive junction in the same frequency band. As shown in FIG. 5, the center conductor 82 of the connector 60 is capacitively coupled to a transmission line center conductor 84 that leads to the input port (not shown) of corresponding circuitry within the housing. In an alternative embodiment, the connector center conductor 82 is conductively coupled to the transmission line center conductor 84.

Although the present invention has been described in conjunction with its preferred embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. An antenna apparatus comprising:

a housing having a ground plane;

at least one antenna element located within said housing;

an input/output connector mechanically coupled to said housing; and a transmission line that transfers electromagnetic energy between said input/output connector and said at least one antenna element;

wherein said input/output connector includes a conductive ground portion that is predominantly capacitively coupled to said ground plane in said housing within an operative electromagnetic frequency range of said at least one antenna element, said conductive ground portion also being conductively coupled to said ground plane in said housing to provide a flow path for direct current (DC) signals coupled between said conductive ground portion and said ground plane, said conductive ground portion including a conductive short circuiting member that provides said ground plane portion being conductively coupled to said ground plane.

2. The antenna apparatus claimed in claim 1, wherein:

said conductive ground portion of said input/output connector includes a connector flange that provides said conductive ground plane portion that is capacitively coupled to said ground plane, said flange is mechanically coupled to said housing.

3. The antenna apparatus claimed in claim 2, wherein:

said flange of said input/output connector is separated from said ground plane by a dielectric layer for providing a capacitance therebetween, said capacitance presenting a relatively low reactance value to signals within said operative electromagnetic frequency range of said at least one antenna element.

4. The antenna apparatus claimed in claim 1, wherein:

said input/output connector includes a center conductor for use in coupling electromagnetic energy into or out of said antenna apparatus, wherein said center conductor of said input/output connector is conductively coupled to a center conductor of said transmission line.

5. The antenna apparatus claimed in claim 1, wherein:

said conductive short circuiting member is integrally attached to said conductive ground portion of said input/output connector.

6. The antenna apparatus claimed in claim 1, wherein:

said input/output connector includes a conductive coaxial transition for attaching an external coaxial cable to said input/output connector and a conductive flange portion for attaching said input/output connector to said housing, said conductive coaxial transition being located on and conductively coupled to said conductive flange portion, wherein said conductive short circuiting member is attached to said conductive flange portion at a point that is closer to an outer edge of said conductive flange portion than said point is to said conductive coaxial transition.

7. The antenna apparatus claimed in claim 1, wherein:

said conductive coupling between said conductive ground portion of said input/output connector and said ground plane presents a first reactance magnitude to signals within said operative electromagnetic frequency range of said at least one antenna element and said capacitive coupling between said conductive ground portion of said input/output connector and said ground plane presents a second reactance magnitude to said signals within said operative electromagnetic frequency range, wherein said first reactance magnitude is significantly greater than said second reactance magnitude.

8. The antenna apparatus claimed in claim 7, wherein:

said first reactance magnitude is at least five times greater than said second reactance magnitude.

9. The antenna apparatus claimed in claim 1, wherein:

said input/output connector includes a center conductor for use in coupling electromagnetic energy into or out of said antenna apparatus, wherein said center conductor of said input/output connector is capacitively coupled to a center conductor of said transmission line.

10. A connector for use in coupling electromagnetic energy between an antenna element within an antenna housing and an external cable, comprising:

a conductive coaxial transition for attaching the external cable to said connector, said conductive coaxial transition providing a ground connection between said connector and the external cable when the cable is attached thereto;

a conductive plane conductively coupled to said conductive coaxial transition, said conductive plane having a surface area for providing a capacitance with a second conductive plane that is part of a ground structure of the antenna housing, said capacitance providing a relatively low impedance value within an operative frequency range of the antenna element within the antenna housing to provide capacitive coupling between said conductive coaxial transition of said connector and said ground structure within the antenna housing; and a conductive short circuiting member conductively coupled to said conductive coaxial transition for providing a conductive path between said conductive coaxial transition and the ground structure within the antenna housing.

11. The connector claimed in claim 10, wherein:

said conductive plane is part of a flange on said connector.

12. The connector claimed in claim 10, wherein:

said conductive coaxial transition includes threads for engaging corresponding threads on a cable connector of the external cable.

13. An antenna unit comprising:

a housing having an internal ground structure;

at least one antenna element located within said housing, said at least one antenna element including a signal port for passing electromagnetic signals to or from said at least one antenna element, said at least one antenna element having a predetermined frequency range of operation;

means for capacitively coupling a ground portion of a cable located outside said housing to said internal ground structure of said housing, said means for capacitively coupling including an input/output connector attached to said housing and with a conductive plane that defines one electrode of a capacitor; and means for conductively coupling said ground portion of said cable to said internal ground structure of said housing, said means for conductively coupling including a conductive member projecting outward from and conductively coupled to said conductive plane;

wherein a signal within said predetermined frequency range flowing between said ground portion of said cable and said internal ground structure will flow predominately through said means for capacitively coupling.

14. The antenna unit claimed in claim 13, further comprising:

means for capacitively coupling a center conductor of said cable to said signal port of said at least one antenna element.

15. The antenna unit claimed in claim 13, wherein:

said conductive plane couples said input/output connector to said internal ground structure of said housing, said input/output connector also including means for attaching a ground portion of said cable to said input/output connector, wherein said means for attaching is conductively coupled to said conductive plane.

16. The antenna unit claimed in claim 13, wherein:

said conductive plane is part of a flange of said input/output connector.

17. The antenna unit claimed in claim 13, further comprising:

means for conductively coupling a center conductor of said cable to said signal port of said at least one antenna element.

18. A method for transferring radio frequency (RF) energy relative to RF circuitry, comprising:

providing circuitry housing with a ground plane and with circuitry located within said circuitry housing;

providing an input/output connector that includes a conductive ground portion that is predominantly capacitively coupled to said ground plane; and establishing a substantially direct current (DC) short circuit using a conductive short circuiting member that is conductively coupled to said ground plane.

19. A method, as claimed in claim 18, wherein:

said input/output connector includes a conductive coaxial transition and further including attaching an external coaxial cable said conductive coaxial transition.

20. A method, as claimed in claim 19, wherein:

said input/output connector further includes a conductive flange portion and with said conductive ground portion being part of said conductive flange portion, said conductive coaxial transition being located on and being conductively coupled to said conductive flange portion, and said establishing step includes attaching said short circuiting member to said conductive flange portion at a point that is closer to an outer edge of said conductive flange portion than said point is to said conductive coaxial transition.

21. A method, as claimed in claim 18, wherein:

said conductive ground portion is predominately capacitively coupled to said ground plane within an operative electromagnetic frequency range associated with said circuitry.

22. A method, as claimed in claim 18, wherein:

said establishing step includes attaching said short circuiting member to said conductive ground portion of said input/output connector.

23. An apparatus for transferring radio frequency (RF) energy relative to RF circuitry, comprising:

circuitry housing with a ground plane and with circuitry located within said circuitry housing;

an input/output connector that includes a conductive ground portion that is predominantly capacitively coupled to said ground plane; and a conductive short circuiting member that is conductively coupled to said ground plane and attached to said conductive ground portion that establishes a substantially direct current (DC) short circuit.

24. An apparatus, as claimed in claim 23, wherein:

said conductive ground portion is predominately capacitively coupled to said ground plane within an operative electromagnetic frequency range associated with said circuitry.

25. An apparatus, as claimed in claim 23, wherein:

said circuitry housing is an antenna housing and said circuitry includes at least one antenna element.

* * * * *